US011273383B2

(12) United States Patent
Briggs

(10) Patent No.: US 11,273,383 B2
(45) Date of Patent: Mar. 15, 2022

(54) WATER RIDE ATTRACTION INCORPORATING A STANDING WAVE

(71) Applicant: WHITEWATER WEST INDUSTRIES LTD., Richmond (CA)

(72) Inventor: Rick Briggs, Springfield, IL (US)

(73) Assignee: WHITEWATER WEST INDUSTRIES LTD., Richmond (CA)

( * ) Notice: Subject to any disclaimer, the term of this patent is extended or adjusted under 35 U.S.C. 154(b) by 0 days.

(21) Appl. No.: 16/188,190

(22) Filed: Nov. 12, 2018

(65) Prior Publication Data

US 2019/0143227 A1 May 16, 2019

Related U.S. Application Data

(60) Provisional application No. 62/584,583, filed on Nov. 10, 2017.

(51) Int. Cl.
*A63G 21/18* (2006.01)

(52) U.S. Cl.
CPC ..... *A63G 21/18* (2013.01)

(58) Field of Classification Search
CPC ..... A63G 21/18; A63G 21/00; A63G 31/007; A63G 31/00; A63G 31/04; E04H 4/00
USPC ..... 472/117, 118; 405/79
See application file for complete search history.

(56) References Cited

U.S. PATENT DOCUMENTS

| | | | | |
|---|---|---|---|---|
| X419860 | | 1/1890 | Libbey | |
| 419,860 | A * | 1/1890 | Libby | A63G 3/00 104/73 |
| X435227 | | 8/1890 | Inglis | |
| X490484 | | 1/1893 | Mackaye | |
| X586718 | | 7/1897 | Wharton, Jr. | |
| X586983 | | 7/1897 | Wharton, Jr. | |
| X654980 | | 7/1900 | Howard | |
| X799708 | | 9/1905 | Boyce | |
| 1,392,533 | A | 10/1921 | Smyth | |
| 1,693,459 | A | 3/1925 | Paulus | |
| 1,536,875 | A | 5/1925 | Bowen | |
| 1,655,498 | A | 1/1928 | Fisch | |
| 1,701,842 | A | 2/1928 | Fisch | |
| 1,871,215 | A | 8/1932 | Keller | |
| 1,884,075 | A | 10/1932 | Meyers | |
| 2,117,982 | A | 5/1938 | Prince, Jr. | |
| 2,558,759 | A | 7/1951 | Johnson | |
| 2,815,951 | A | 12/1957 | Baldanza | |
| 3,005,207 | A | 10/1961 | Matrai | |
| 3,038,760 | A | 6/1962 | Crooke | |

(Continued)

FOREIGN PATENT DOCUMENTS

| | | |
|---|---|---|
| AU | 2007201135 | 4/2007 |
| BR | PI0721429-4 | 3/2014 |

(Continued)

*Primary Examiner* — Michael D Dennis
(74) *Attorney, Agent, or Firm* — Benjamin C. Deming; Buchalter, a Professional Corp.

(57) ABSTRACT

A waterslide attraction provides multiple standing waves interspersed with multiple flume elements. The multiple standing waves may vary in steepness and the flume elements may include turns of vary degree. A first standing wave may be higher than succeeding standing waves and a first turn may be higher than succeeding turns. An exit slide connected to the waterslide attraction may direct a rider to a runout pool.

7 Claims, 1 Drawing Sheet

(56) References Cited

U.S. PATENT DOCUMENTS 3,085,404 A 4/1963 Smith
3,120,385 A 2/1964 Hall
3,216,455 A 11/1965 Cornell
3,363,583 A 1/1968 Greenberg
3,473,334 A 10/1969 Dexter
3,477,233 A 11/1969 Andersen
3,478,444 A 11/1969 Presnell
3,497,211 A 2/1970 Nagin
3,523,307 A 8/1970 Buswell
3,547,749 A 12/1970 White
3,557,559 A 1/1971 Barr
3,562,823 A 2/1971 Koster
3,565,491 A 2/1971 Frazier
3,578,810 A 5/1971 Newstead
3,598,402 A 8/1971 Frenzl
3,611,727 A 10/1971 Blandford
3,613,377 A 10/1971 Zaugg
3,757,370 A 9/1973 Seno
3,789,612 A 2/1974 Richard
3,802,697 A 4/1974 Le Mehaute
3,845,510 A 11/1974 Baker
3,850,373 A 11/1974 Grolitsch
3,851,476 A 12/1974 Edwards
3,853,067 A 12/1974 Bacon
3,913,332 A 10/1975 Forsman
3,981,612 A 9/1976 Bunger
4,062,192 A 12/1977 Biewer
4,087,088 A 5/1978 Kelso
4,122,560 A 10/1978 Baker
4,147,844 A 4/1979 Babinky et al.
4,149,710 A * 4/1979 Rouchard ..... A63G 21/18 104/70
4,192,499 A * 3/1980 Groves, Jr. ..... A63G 21/02 104/69
4,196,900 A * 4/1980 Becker ..... A63G 21/00 472/117
4,197,815 A 4/1980 Brazelton
4,198,043 A 4/1980 Timbes
4,201,496 A 5/1980 Andersen
4,244,768 A 1/1981 Wiechowski et al.
4,246,980 A 1/1981 Miller
4,276,664 A 7/1981 Baker
4,278,247 A 7/1981 Joppe
4,339,122 A 7/1982 Croul
4,374,169 A 2/1983 Gryskiewicz et al.
4,429,867 A 2/1984 Barber
4,474,369 A 10/1984 Gordon
4,522,535 A 6/1985 Bastenhof
4,539,719 A 9/1985 Schuster
4,557,475 A 12/1985 Donovan
4,561,133 A 12/1985 Laing
4,564,190 A 1/1986 Frenzl
4,574,107 A 3/1986 Ferrari
4,662,781 A 5/1987 Tinkler
4,707,869 A 11/1987 Ray
4,736,912 A 4/1988 Loebert
4,762,316 A 8/1988 Merino
4,790,155 A 12/1988 Daniel
4,790,685 A 12/1988 Scott
4,792,260 A * 12/1988 Sauerbier ..... A63B 69/0093 405/79
4,805,897 A 2/1989 Dubeta
4,806,048 A 2/1989 Ito
4,836,521 A 6/1989 Barber
4,895,875 A 1/1990 Winston
4,903,959 A 2/1990 Barber
4,905,987 A 3/1990 Frenzl
4,954,014 A 9/1990 Sauerbier
4,976,422 A 12/1990 Shimamura
4,988,364 A 1/1991 Perusich et al.
5,005,762 A 4/1991 Cacoub
5,020,465 A 6/1991 Langford
5,061,211 A 10/1991 Barber
5,125,577 A 6/1992 Frankel
5,137,497 A 8/1992 Dubeta
5,170,901 A 12/1992 Bersani
5,171,101 A 12/1992 Sauerbier
5,183,438 A 2/1993 Blom
5,213,547 A 5/1993 Lochtefeld
5,219,315 A 6/1993 Fuller
5,236,280 A * 8/1993 Lochtefeld ..... A63B 69/0093 405/52
5,236,404 A 8/1993 Maclennan
RE34,407 E 10/1993 Frenzl
5,267,812 A 12/1993 Suzuki
5,271,692 A 12/1993 Lochtefeld
5,285,536 A 2/1994 Long
5,314,383 A 5/1994 Fabbi
5,342,145 A 8/1994 Cohen
5,370,591 A 12/1994 Jewell
5,378,197 A 1/1995 Briggs
5,384,019 A 1/1995 Keating
5,385,518 A 1/1995 Turner
5,387,159 A 2/1995 Hilgert
5,393,170 A 2/1995 Lochtefeld
5,401,117 A 3/1995 Lochtefeld
5,421,782 A 6/1995 Lochtefeld
5,427,574 A 6/1995 Donnelly-Weide
5,447,636 A 9/1995 Banarjee
5,453,054 A 9/1995 Langford
5,503,597 A 4/1996 Lochtefeld
5,524,310 A 6/1996 Farnen
5,540,622 A 7/1996 Gold
5,564,859 A 10/1996 Lochtefeld
5,621,925 A 4/1997 Bastenhof
5,628,584 A * 5/1997 Lochtefeld ..... A63C 19/00 405/79
5,638,556 A 6/1997 Kipers
5,667,445 A 9/1997 Lochtefeld
5,676,601 A 10/1997 Saunders
5,738,590 A 4/1998 Lochtefeld
5,779,553 A 7/1998 Langford
5,827,608 A 10/1998 Rinehart et al.
5,899,633 A 5/1999 Lochtefeld
5,899,634 A 5/1999 Lochtefeld
5,937,586 A 8/1999 Scherba
6,019,547 A 2/2000 Hill
6,047,657 A 4/2000 Cox
6,112,489 A 9/2000 Zweig
6,132,317 A 10/2000 Lochtefeld
6,223,673 B1 5/2001 Mears
6,312,341 B1 11/2001 Healy
6,319,137 B1 11/2001 Lochtefeld
6,336,771 B1 1/2002 Hill
6,345,791 B1 2/2002 McClure
6,363,677 B1 4/2002 Chen
6,375,578 B1 4/2002 Briggs
6,405,387 B1 6/2002 Barnes
6,454,659 B1 9/2002 Noble
6,460,201 B1 10/2002 Lochtefeld
6,491,589 B1 12/2002 Lochtefeld
6,527,646 B1 3/2003 Briggs
6,558,264 B2 5/2003 Gordon
6,562,771 B2 5/2003 Finch
6,616,542 B1 9/2003 Reddick
6,634,953 B1 10/2003 Czintos
6,647,689 B2 11/2003 Pletzer
6,676,530 B2 1/2004 Lochtefeld
6,716,107 B2 4/2004 Lochtefeld
6,726,403 B1 4/2004 Kriticos
6,743,107 B2 6/2004 Dubeta
6,758,231 B1 7/2004 Lochtefeld
6,796,096 B1 9/2004 Heath
6,920,651 B2 7/2005 Roberts
7,056,220 B2 6/2006 Hunter
7,073,977 B2 7/2006 Unterweger
7,224,252 B2 5/2007 Meadow
7,285,053 B2 10/2007 Henry
7,513,504 B2 4/2009 Lochtefeld
7,547,255 B2 6/2009 Lochtefeld
7,607,271 B2 10/2009 Griffin
7,666,104 B2 2/2010 Lochtefeld
7,713,134 B2 5/2010 Hunter
7,717,645 B2 5/2010 McLaughlin

(56) References Cited

U.S. PATENT DOCUMENTS

| | | | | |
|---|---|---|---|---|
| 7,718,246 | B2 | 5/2010 | Strauss | |
| 7,775,895 | B2 | 8/2010 | Henry | |
| 7,789,804 | B1 | 9/2010 | Phillips | |
| 7,951,011 | B2 | 5/2011 | Lochtefeld | |
| 7,958,669 | B2 | 6/2011 | Casimaty | |
| 8,042,200 | B2 | 10/2011 | Webber | |
| 8,056,295 | B2 | 11/2011 | Cappelle | |
| 8,088,016 | B2 | 1/2012 | Murphy | |
| 8,290,636 | B2 | 10/2012 | Manning | |
| 8,550,926 | B2 | 10/2013 | Lochtefeld | |
| 8,641,543 | B2 | 2/2014 | Lochtefeld | |
| 8,771,093 | B2 | 7/2014 | Bowen | |
| 8,784,224 | B1 | 7/2014 | Schafer | |
| D717,899 | S | 11/2014 | Chen | |
| 8,882,604 | B2 | 11/2014 | Lochtefeld | |
| 9,072,927 | B2 | 7/2015 | Sammann | |
| 9,175,488 | B2 | 11/2015 | Fricano | |
| 9,194,146 | B2 | 11/2015 | Murphy | |
| 9,254,428 | B2 | 2/2016 | Kriticos | |
| 9,409,094 | B1 | 8/2016 | Wulf | |
| 9,463,390 | B2 | 10/2016 | Vicente | |
| 9,550,127 | B2 | 1/2017 | Lochtefeld | |
| 9,586,159 | B2 | 3/2017 | Coleman | |
| 9,592,433 | B2 | 3/2017 | Alleshouse | |
| 9,756,658 | B2 | 9/2017 | Murphy | |
| 9,795,890 | B1 | 10/2017 | Bradshaw | |
| 9,878,255 | B2 | 1/2018 | Kriticos | |
| 10,195,535 | B2 | 2/2019 | Koide | |
| 10,335,694 | B2 | 7/2019 | Koide | |
| 10,376,799 | B2 | 8/2019 | Vicente | |
| 10,525,362 | B2 | 1/2020 | Vicente | |
| 2003/0004003 | A1 | 1/2003 | Lochtefeld | |
| 2003/0015221 | A1 | 1/2003 | Weir | |
| 2003/0029109 | A1 | 2/2003 | Hellberg | |
| 2003/0153221 | A1 | 8/2003 | Weir | |
| 2004/0216226 | A1 | 11/2004 | Demarteau | |
| 2007/0167246 | A1 | 7/2007 | McKee | |
| 2008/0060123 | A1 | 3/2008 | Lochtefeld | |
| 2008/0216427 | A1 | 9/2008 | Lochtefeld | |
| 2008/0286047 | A1* | 11/2008 | Carnahan | A63G 21/18 405/79 |
| 2008/0286048 | A1 | 11/2008 | Carnahan | |
| 2008/0293505 | A1 | 11/2008 | Northam | |
| 2009/0029785 | A1 | 1/2009 | McKee | |
| 2009/0137330 | A1 | 5/2009 | Sefchick | |
| 2009/0169305 | A1 | 7/2009 | Lochtefeld | |
| 2011/0143846 | A1 | 6/2011 | Davis | |
| 2011/0314589 | A1 | 12/2011 | Vito et al. | |
| 2012/0037198 | A1 | 2/2012 | Cantin | |
| 2013/0074254 | A1 | 3/2013 | Payne et al. | |
| 2013/0184087 | A1* | 7/2013 | Degirmenci | A63G 21/18 472/117 |
| 2014/0357387 | A1 | 12/2014 | Murphy | |
| 2015/0065261 | A1 | 3/2015 | Lochtefeld | |
| 2016/0076267 | A1 | 3/2016 | Murphy | |
| 2016/0136529 | A1* | 5/2016 | Weston | A63G 31/007 472/117 |
| 2016/0288001 | A1* | 10/2016 | Johnson | A63G 21/18 |
| 2017/0043264 | A1* | 2/2017 | Hunter | A63G 21/18 |
| 2017/0136373 | A1 | 5/2017 | Myrman | |
| 2019/0046887 | A1 | 2/2019 | Myrman | |
| 2019/0063092 | A1* | 2/2019 | Fincham | E04H 4/0006 |
| 2019/0314729 | A1 | 10/2019 | Koide | |
| 2019/0321737 | A1 | 10/2019 | Koide | |
| 2020/0147505 | A1 | 5/2020 | Vicente | |

FOREIGN PATENT DOCUMENTS

| | | |
|---|---|---|
| CH | 176562 | 4/1935 |
| DE | 159793 | 8/1903 |
| DE | 271412 | 11/1912 |
| DE | 373684 | 4/1932 |
| DE | 1210155 | 2/1966 |
| DE | 2222594 | 11/1973 |
| DE | 2714223 | 10/1978 |
| DE | 3445976 | 12/1984 |
| EP | 96216 | 12/1983 |
| FR | 1019527 | 1/1953 |
| FR | 1300144 | 8/1962 |
| FR | 2219504 | 9/1974 |
| FR | 271977 | 7/1992 |
| FR | 2671977 | 7/1992 |
| GB | 375684 | 6/1932 |
| GB | 1090262 | 11/1967 |
| GB | 1118083 | 6/1968 |
| GB | 1204629 | 9/1970 |
| GB | 2223414 | 4/1990 |
| JP | 52-41392 | 3/1977 |
| JP | H03258280 | 11/1991 |
| NO | 310138 | 12/1992 |
| SU | 682238 | 8/1979 |
| SU | 953075 | 8/1982 |
| WO | 1983/004375 | 12/1983 |
| WO | 2000/005464 | 2/2000 |
| WO | 2000/064549 | 11/2000 |
| WO | 2002/058810 | 8/2002 |
| WO | 2014/153456 | 9/2014 |

* cited by examiner

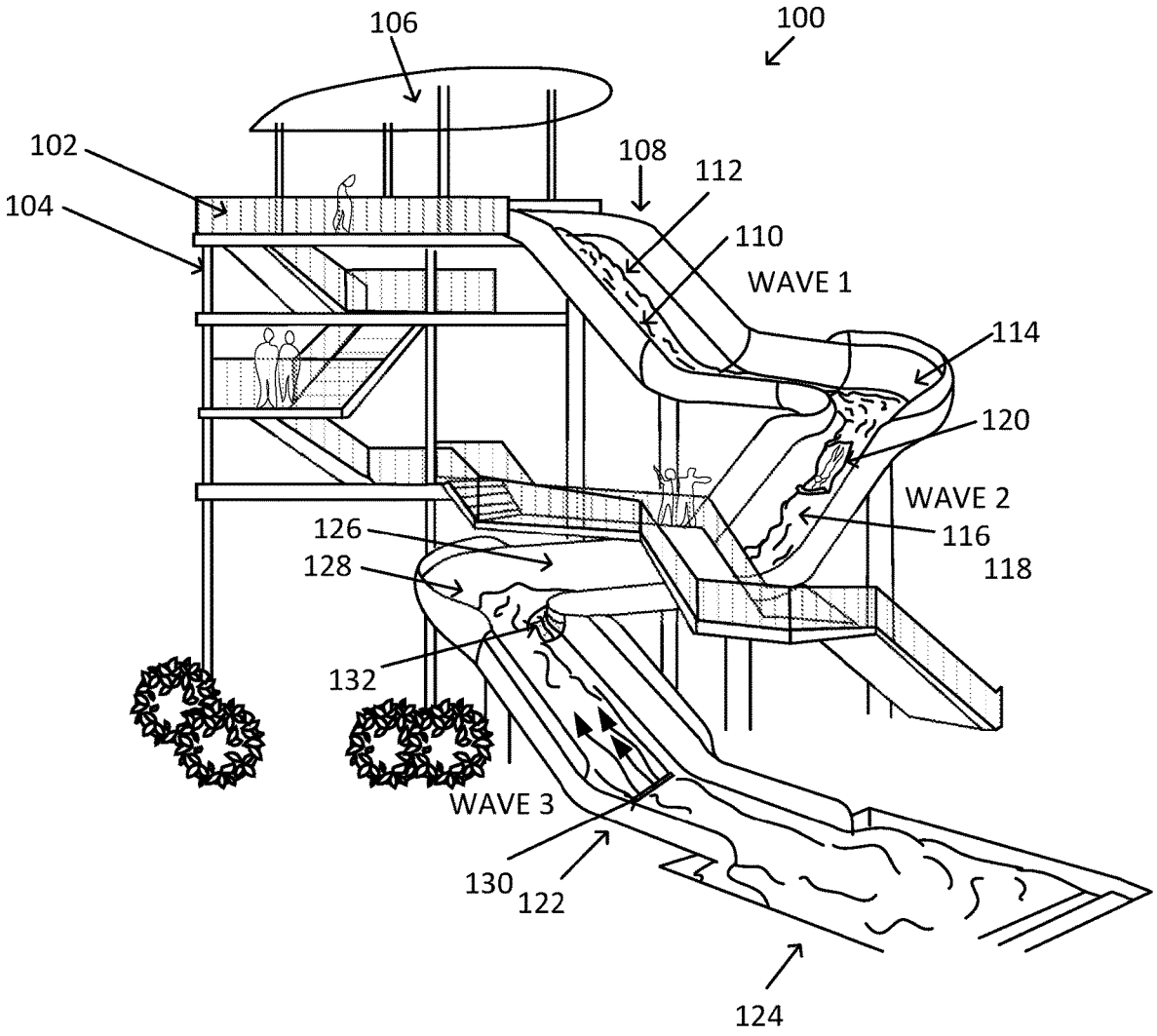
100
106
102
104
108
112
110
WAVE 1
114
120
WAVE 2
116
118
126
128
132
WAVE 3
130
122
124

WATER RIDE ATTRACTION INCORPORATING A STANDING WAVE

PRIORITY

This application claims the benefit of U.S. Provisional Patent Application Ser. No. 62/584,583, filed on Nov. 10, 2017, entitled "Water Ride Attraction Incorporating a Standing Wave," which is hereby incorporated by reference in its entirety.

BACKGROUND

Waterslide attractions typically provide riders with a thrilling experience of speed and lateral force upon the body as the riders slide on the attraction. A stream of water is commonly flowed along a flume from an entrance location of higher elevation to an exit location of lower elevation. A rider slides along the flume due to the stream of water, either with or without a ride vehicle, and experiences the twists, turns, and drops predetermined by the design and setup of the flume.

SUMMARY

The present invention relates generally to water ride attractions. More particularly, the present invention relates to waterslide attractions capable of incorporating a standing wave. Exemplary embodiments may therefore include a water ride attraction having a flume with a stream of water flowing from a position of higher elevation to a position of lower elevation, such that a rider (either with or without a ride vehicle) rides along the flume with the flow of water. Exemplary embodiments of the water ride attraction may have a portion of the flume configured to support a standing wave, such that the flume supports one or more water injectors for directing water from a position of lower elevation to a position of higher elevation, such that a rider (either with or without a ride vehicle) rides along the flume against the flow of water or is held relatively stationary along the flume path by the flow of water.

BRIEF DESCRIPTION OF THE DRAWINGS

Other systems, methods, features, and advantages of the present invention will be or will become apparent to one with skill in the art upon examination of the following FIGURES and detailed description. It is intended that all such additional systems, methods, features, and advantages be included within this description, be within the scope of the present invention, and be protected by the accompanying claims. Component parts shown in the drawings are not necessarily to scale and may be exaggerated to better illustrate the important features of the present invention. In the drawings, like reference numerals designate like parts throughout the different views, wherein:

FIG. 1 shows a perspective view of a waterslide attraction capable of incorporating standing waves and flumes having turns according to an embodiment of the present invention.

DETAILED DESCRIPTION

The detailed description of exemplary embodiments herein makes reference to the accompanying drawings and pictures, which show the exemplary embodiments by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

A waterside attraction is provided that incorporates at least one standing wave element and at least one flume that may include at least one turn element. The standing wave elements and flume elements may alternate so that a rider experiences first a standing wave and then a turn or visa versa. Multiple standing waves may also be incorporated. The multiple standing waves may be separated by turns. A ramp may direct riders to the first standing wave element. Flume or turn elements may be of varying degrees and standing waves may vary in steepness. Additional embodiments may provide for differing configurations (e.g., height, width, shape, degrees, etc.) of flume elements and may be adapted to specific terrain.

FIG. 1 shows a perspective view of a waterslide attraction 100. A boarding area or observation deck 102 is positioned and/or connected with a support structure 104 (e.g., on a top portion of the support structure 104). Observation deck 102 may have a shape substantially as depicted. In an alternative embodiment the observation deck may have a round, oval, and/or any other shape or configuration and/or may be shaped or configured to reflect a theme for the water attraction. The support structure 104 may be substantially as depicted, as a scaffolding structure to support the flumes or slides and ride elements of the waterslide attraction 100. The support structure 104 may incorporate multiple stairs and viewing sections 118 to allow those queued to watch other riders. In an alternative embodiment, support structure 104 may be reduced to accommodate sloping terrain. Support structure 104 may be adapted to the terrain and riders may enter at the top of the ride and exit at the bottom. The support structure 104 may also be adapted to allow riders to enter at the bottom of the ride and climb to the top for the ride down, as shown in FIG. 1. The waterslide attraction 100 may incorporate a cover or awning 106 (e.g., to provide shade to waiting participants). Sequenced light bars may be incorporated into the cover or awning 106 and may incorporate a timing indicator to signal a rider launch sequence. Other indications (e.g., music or other audible signals) may be incorporated and used to indicate that a rider is about to or should launch. The indications, such as audible tones and/or light elements, may indicate boarding initiation and may be used to entertain riders waiting to board. The indications may be located in different positions relative to the flume and/or ride entrance.

An entry slide or flume 108 connects the observation deck and boarding area 102 with the first standing wave 110 of the waterslide attraction 100. The entry slide or flume 108 accelerates or otherwise provides a rider 120 on a sliding surface 112 propelled by water forced or flowed along the entry slide or flume 108 toward the first standing wave 110. The standing wave 110 is generally created by providing a sloped ride surface with water flowing in an opposite direction to that of rider travel due to gravity (e.g., water flow's substantially upwardly on the sloped ride surface to create the standing wave 110). Accordingly, instead of traveling with the flow' of water down the standing wave 110, the rider 120 may perform surfing maneuvers and/or bodyboarding maneuvers (e.g., traveling laterally, side-to-side upon the standing wave 110). The flume for containing the standing wave 110 may be designed with a consistent width or similar to certain characteristics or specifications of simulated surfing attractions, for example, as disclosed in prior United States patents or publications, such as U.S. Pat. Nos. 6,491,589, 6,676,530, 7,547,255, and/or 9,463,390, whose disclosures are incorporated herein by reference in their entirety. Certain of such concepts for simulated surfing via a standing wave are modified as discussed herein for incorporation into a waterslide attraction, such as the waterslide attraction 100 explicitly shown in FIG. 1.

The standing wave 110 may vary in steepness and/or different standing waves may be defined at varying steepness. Rider 120 may be on a ride vehicle, such as a small surfboard, boogie board, or other ride vehicle in one embodiment or may not use any ride vehicle in an alternative embodiment. Entry slide or flume 108 may be a downward sloping ramp to move the rider 120 down the ride with sufficient speed to enter the first standing wave 110 whereby the rider 120 may then stand, perform turns, and/or engage in other surfing-type or body board-type moves on the first standing wave 110. The first standing wave 110 provides a flow of water in a direction of travel opposite to that of rider 120 (e.g., an opposing flow to the flow of water preceding the first standing wave 110). This flow of water creates the standing wave in first standing wave 110 and permits that rider 120 to perform surfing-type movements.

The waterslide attraction 100 may include sensors or other equipment configured to determine when a rider is adjacent to or within a portion of the ride encompassing a standing wave, such as the standing wave 110. Such sensors or other equipment may be used to turn the opposite flow of water that creates the standing wave on or off. For example, in certain embodiments, water forming the standing wave 110 may be turned on via control of nozzles or jets disposed at or near a bottom of the standing wave 110 based upon the expected arrival of the rider 120 at the standing wave 110. In another example, in certain embodiments, the water forming the standing wave 110 may be turned off after the rider 120 has entered the standing wave 110 based upon any of a variety of possible inputs (e.g., a period of time has elapsed and/or the rider 120 has performed some particular task that triggers the removal of the standing wave 110, such as traveling back-and-forth across the standing wave 110 a predetermined number of times). By controlling the components that deliver water which forms the standing wave 110, the standing wave 110 need not remain in operation at all times during operation of the waterslide attraction 100, potentially saving energy, costs, maintenance, etc.

Exemplary embodiments of a waterslide attraction 100 may include one or more components to deliver water along the ride path. The one or more components to deliver water may be directed such that water is directed upon the ride surface up the ride surface or in a direction from lower elevation to a position of higher elevation. The one or more components to deliver water may be configured to control the amount of water flow to correspond with a desired characteristic of a standing wave. The water flow may therefore be controlled such that a rider or riders on the standing wave may be maintained at an approximately elevation or position along the flume to perform tricks or traverse laterally across the standing wave for a time duration. The water flow may also or alternatively be controlled such that a rider or riders on the standing ride may be permitted to cross the standing wave and progress downward against the flow of water. The water flow may therefore be reduced from or turned off at the one or more components to deliver water to permit a rider to exit the standing wave past the one or more components to deliver water or along the flume at the bottom of the standing wave.

Exemplary embodiments of a waterslide attraction 100 may include one or more components to deliver water along the ride path in which the one or more components are configured to deliver water directed along the direction of travel, i.e. from a position of higher elevation to a position of lower elevation. The one or more components to deliver water may be controlled such that a rider or riders on the section of ride may a propelled along the ride surface from a direction toward the entrance toward a direction of the exit of the waterslide attraction.

Regardless of the orientation, the one or more components to deliver water may be controlled to manage the amount and corresponding force imposed on a rider from the one or more components to deliver water. The one or more components to deliver water may also be individually or separately controlled in one or more groups of components. For example, a first set of one or more components may be configured to define a first standing wave and a second set of one or more components may be configured to define a second standing wave. The first set of one or more components may be turned on when a rider or riders is proximate or entering the first wave, while the second set of one or more components is turned off or turned to a reduced injection amount or speed. The first set of one or more components may then be turned off or turned down to permit the rider or riders to traverse exit the first standing wave and enter the second standing wave. The second set of one or more components may thereafter be turned on or turned up to pause or slow the downward decent of the rider or riders to permit tricks or other activities to be performed at the second standing wave. The second set of one or more components may thereafter be turned off and/or down to permit the rider or riders to exit the second standing wave.

In an exemplary embodiment, the one or more components to deliver water may be positioned along the flume. The one or more components may be positioned at lateral sides of a ride path in the flume, such that the waterslide attraction is configured to permit a rider to pass between the components to deliver water when leaving the standing wave. The one or more components may also include a cover or be configured such that a rider may ride over the one or more components when exiting the standing wave.

In an exemplary embodiment, the water slide attraction 100 may include one or more drains to remove water from the water slide surface. For example, one or more components for delivering water 130 may be positioned at a lower elevation at a bottom of the standing wave portion of the water slide attraction. One or more components for removing water 132, such as a drain, may be positioned at a higher elevation or at a top of a standing wave portion of the water slide attraction. The removal of the water from the top of the standing wave may reduce the interference of the injected water as it tries to change direction at the top of the standing wave and traverse the standing wave against the flow of the injected water. In an exemplary embodiment, the one or more components for removing water 132 may be positioned at or in the transition areas, such as turns 128, between standing waves.

In an exemplary embodiment, the drain may be a portion of the ride surface. For example, a central or middle area longitudinally along the ride surface may define a surface to be traversed by a rider. An exterior or lateral edge on one or opposing sides of the central or middle area may be configured to move water in an opposing direction and drain water from the ride surface. The different sections may be separated such as with dividers and/or contours of the ride surface or may be integral and defined only by opposing directions of the water thereon.

Exemplary embodiments may include a water ride attraction defining an elevation flume with a first portion of higher elevation than a second portion. The water ride attraction is configured such that a rider traverses the attraction from the first portion of higher elevation to the second portion of lower elevation. The water ride attraction include one or more components for injecting water along a ride surface of the water ride attraction from a first position of lower elevation to a second position of higher elevation, wherein the first and second positions are between the first and second portions of the water ride attraction. The one or more components therefore inject water along the ride surface against the direction of travel between the entrance to the exit of the water ride attraction. The one or more components are configured to slow, or pause the decent of the rider(s) along the flume to permit the rider to laterally traverse the flume and/or perform other tricks or activities such as those performed on a standing wave or sheet wave attraction.

Exemplary embodiments may include a water ride attraction having the elevated flume in which a portion of the water ride attraction is configured such that a rider traverses or travels along the flume in a direction with the water flow from a direction nearer the entrance of the water ride attraction in a direction towards the exit of the water ride attraction. Accordingly, the water ride attraction may be configured with different portions have water flowing in different directions of with and against the ride direction from the entrance toward the exit of the water ride attraction. The different water directions may occur simultaneously or sequentially. The different water directions may be created by varying the amount and/or direction of water injected through one or more water injection components along the flume ride path.

The entry slide or flume 108 may be angled substantially as shown in FIG. 1. Such a configuration causes the rider 120 to move from one element or section of the ride to the next.

First standing wave 110 may be directly connected to a first turn 114. First turn 114 may turn the rider 120 in a different direction and directs the rider 120 toward a second standing wave 116. First turn 114 may be 90 degrees as shown in FIG. 1, or may be a different angle in an alternative embodiment. Entry into first turn 114 may be direct or a very short transition that does not allow the rider 120 to recover from the exit of first standing wave 110. This provides additional thrills and excitement because the rider spends little or no time without participating in an element.

Upon exiting from first turn 114, a rider 120 enters standing second standing wave 116. Second standing wave 116 operates in a similar manner to first standing wave 110. Upon exiting second standing wave 116, a rider 120 may enter a transition section 126. Transition section 126 may connect to second turn 128. Second turn 128 may be as described above for first turn and in an alternative embodiment may have a different angle, which may be dictated by terrain features or design. At the exit of second turn 128, a rider 120 may enter an exit flume or slide 122. Exit flume or slide 122 directs a rider into runout pool 124.

A particular waterslide attraction may be configured using the same or similar features described above for single riders, double riders, or family riders. Riders may ride the waterslide attraction with or without a ride vehicle, and the ride elements may be adapted to work in cooperation with the ride vehicle.

Additional features (e.g., safety features) may be incorporated into certain embodiments of a waterslide using the above concepts. For example, a netting, fencing, enclosure via walls or other boundary elements (e.g., fiberglass) may be provided along all or some portions of the waterslide, such as at least a portion of a perimeter of one or more standing wave sections of a waterslide for helping ensure a rider stays upon the riding surface during the simulated surfing sections that may otherwise allow the rider to travel back-and-forth and potentially leave the lateral sides of the ride surface.

Any of the above features discussed may be utilized or incorporated or combined with or into other waterpark or amusement park attractions discussed or retrofitted onto existing waterpark or amusement park ride designs. The previous description of the disclosed examples is provided to enable any person of ordinary skill in the art to make or use the disclosed methods and apparatus. Accordingly, the terminology employed throughout should be read in a non-limiting manner. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and/or methods.

What is claimed is:

1. A waterslide attraction, comprising: a flume having a rider entrance at a higher elevation than a rider exit and defining a ride path from the rider entrance to the rider exit; one or more water injection components proximate a lower portion of a first portion of the flume to inject water in a first direction opposite the ride path to generate a standing wave allowing a rider to perform lateral maneuvers in the first portion of the flume, wherein the one or more water injection components are configured to control an amount of water injected to retain a rider at the first portion of the flume for an amount of time; and a transition portion at an exit of the first portion wherein water is directed in a second direction along the ride path; wherein the transition portion defines a turn; a second position of the flume defining a second standing wave and a second transition portion at an exit of the second portion.

2. The waterslide attraction of claim 1, wherein the second transition portion defines a second turn in a different direction from the turn of the transition portion.

3. The waterslide attraction of claim 2, wherein the first portion is at a higher elevation than the transition portion which is at a higher elevation than the second portion which is at a higher elevation than the second transition portion.

4. The waterslide attraction of claim 3, wherein the transition portion turns at least 90 degrees.

5. The waterslide attraction of claim 1, further comprising a drain between the rider entrance and the rider exit.

6. The waterslide attraction of claim 1, wherein the one or more water injection components are configured to control the injected water to retain the rider at the first portion of the flume based upon sensing a task performed by the rider.

7. The waterslide attraction of claim 6, wherein the task performed by the rider includes traveling laterally across the first portion of the flume at least a predetermined number of times.

* * * * *